US007616158B2

(12) United States Patent
Mak et al.

(10) Patent No.: US 7,616,158 B2
(45) Date of Patent: Nov. 10, 2009

(54) MULTI MODE ANTENNA SYSTEM

(75) Inventors: Angus C. K. Mak, Hong Kong (HK); Corbett Rowell, Hong Kong (HK)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 168 days.

(21) Appl. No.: 11/441,823

(22) Filed: May 26, 2006

(65) Prior Publication Data

US 2007/0273606 A1 Nov. 29, 2007

(51) Int. Cl.
*H01Q 1/38* (2006.01)

(52) U.S. Cl. ..... 343/700 MS; 343/702; 343/767

(58) Field of Classification Search ..... 343/700 MS, 343/702, 860, 876, 767
See application file for complete search history.

(56) References Cited

U.S. PATENT DOCUMENTS

| | | | | |
|---|---|---|---|---|
| 5,991,643 | A * | 11/1999 | Chao-Cheng | 455/575.7 |
| 6,307,511 | B1 | 10/2001 | Ying et al. | |
| 6,476,769 | B1 | 11/2002 | Lehtola | |
| 6,650,295 | B2 | 11/2003 | Ollikainen et al. | |
| 6,876,329 | B2 | 4/2005 | Milosavljevic | |
| 7,106,257 | B2 * | 9/2006 | Liu et al. | 343/700 MS |
| 7,215,283 | B2 * | 5/2007 | Boyle | 343/700 MS |
| 2005/0024272 | A1 | 2/2005 | Ponce De Leon et al. | |
| 2008/0129639 | A1 * | 6/2008 | Mitsugi | 343/876 |

FOREIGN PATENT DOCUMENTS

| | | | |
|---|---|---|---|
| CN | 1615039 | A | 5/2005 |
| EP | 0 523 409 | A1 | 6/1992 |
| EP | 1 231 670 | A2 | 8/2002 |
| EP | 1 469 549 | A1 | 4/2004 |
| GB | 2 364 176 | A | 1/2002 |
| GB | 2 371 924 | A | 8/2002 |
| JP | 2001267950 | | 9/2001 |
| JP | 2004172714 | | 6/2004 |
| JP | 2005039756 | | 2/2005 |
| WO | WO 99/50933 | | 10/1999 |
| WO | WO 01/20718 | A1 | 3/2001 |
| WO | WO 2005/029638 | A1 | 3/2005 |
| WO | WO 2005/099039 | A1 | 10/2005 |
| WO | WO 2005109569 | A1 * | 11/2005 |

OTHER PUBLICATIONS

International Search Report issued for PCT/CN2007/001641, dated Aug. 30, 2007, 4 pages.
Matsui, A. et al., "Radiation Properties of Tapered Slot Antenna Constructed with Wire Grid Mesh," Antennas and Propagation Society International Symposium, Jul. 9-14, 2006, pp. 2579-2582, IEEE.

* cited by examiner

*Primary Examiner*—Trinh V Dinh
*Assistant Examiner*—Dieu Hien T Duong
(74) *Attorney, Agent, or Firm*—Fulbright & Jaworski L.L.P.

(57) ABSTRACT

An antenna system comprising a first antenna element, a second antenna element, the first and second elements defining at least in part a slot element, an active switching network in communication with one or both of the first and second antenna elements, the switching network operable to cause the antenna system to resonate in each of two modes: a first mode wherein the first element resonates at a first set of frequencies, and the first element and a second element resonate together at a second set of frequencies; and a second mode wherein the first element resonates at the first set of frequencies, and the slot element resonates at a third set of frequencies.

27 Claims, 4 Drawing Sheets

MULTI MODE ANTENNA SYSTEM

TECHNICAL FIELD

Various embodiments of the invention relate in general to antenna systems and, more specifically, to active antenna systems.

BACKGROUND OF THE INVENTION

Currently, there are a multitude of wireless systems in place, including, inter alia, four varieties of Global System for Mobile Communications (GSM)—GSM 850, 900 GSM, 1800 GSM, 1900 GSM, as well as third generation (3G) systems and emerging fourth generation (4G) systems. BLUETOOTH® and wireless Local Are Network (LAN) capability is also being implemented in mobile phones. Users are demanding more and more functionality, and many wireless engineers are discovering that they need bigger antennas but cannot increase the sizes of handsets.

As a side effect of the popularly recognized Moore's Law for semiconductors, customers and handset suppliers expect consumer technology to keep shrinking in size and increasing in functionality, without regard to the constraints of physics. For many applications, there are fundamental size limitations of antennas that have been reached with today's technology. The antenna, unlike other components inside a handset, sometimes cannot keep decreasing in size. Before the existence of cellular systems, a scientist postulated the physical law responsible for governing antenna size, and the law is now known as "Wheeler's Theorem." In short, Wheeler's Theorem states that for a given resonant frequency and radiation efficiency, the total bandwidth of the system is directly proportional to the size of the antenna. Further, as resonant frequency decreases, antenna size usually increases, and as efficiency increases, antenna size usually increases. Thus, changes to efficiency, bandwidth, or frequency often require changes to antenna size, and changes to frequency, efficiency, or size, often affect bandwidth. This generally represents the physical constraints facing engineers as they design antennas systems for consumer and other devices.

The implications of Wheeler's Theorem for the continued expansion of wireless systems are contrary to consumer expectations regarding bandwidth and size. The space required by antennas in handsets is currently between 5 to 20% of the total space. Generally, either antennas will become much larger to accommodate additional bandwidth, or antenna performance will decrease to accommodate smaller applications. Using what is known about current systems, it is believed that if required bandwidth doubles and performance stays the same, handset size will accordingly increase by up to 20%.

Engineers use active antenna systems to decrease antenna size while giving the appearance of attaining performance gains. Whereas most antennas are passive antennas with up to two connections (feed and ground) to the motherboard/Printed Circuit Board (PCB) and no additional power requirements, an active antenna uses a switching circuit to physically control parts of the antenna. The active antenna system uses the switching element to re-configure the driven antenna elements therein, changing the resonant frequency and maintaining similar efficiency and bandwidth performance for each frequency. Each setting of the antenna acts as a separate antenna for purposes of Wheeler's Theorem; thus, using an active antenna system can seem, in some respects, like receiving several antennas for the physical cost of one. Using this technique, an engineer can design an antenna system that has acceptable performance for multiple wireless networks without incurring the cost in space to accommodate separate antennas.

One kind of active antenna system uses one or more switchable ground connections and/or feed connections on an element to provide a variety of possible feed and/or ground locations, each location causing a different frequency response. One disadvantage of such systems is a lack of ability to independently tune the resonances. Another disadvantage is that such systems generally provide only small shifts in resonant frequency with each adjustment.

The prior art includes no active antenna system that provides independent tuning of one or more frequencies of a multi-band antenna while also providing larger shifts in frequency with each adjustment and which is contained in a volume-efficient package.

BRIEF SUMMARY OF THE INVENTION

Various embodiments of the present invention are directed to systems and methods for providing active antenna systems with two or more operating modes. In one example embodiment, a first conductive plate and a second conductive plate are arranged such that the space between them defines a slot element. Accordingly, the system includes at least three antenna elements. Switching networks are provided that are operable to cause the system to radiate in at least two modes. In a first mode, the first conductive plate radiates Radio Frequency (RF) signals at a first set of resonances, and further, both the first and second conductive plates radiate together at a second set of resonances. In the second mode, the first conductive plate and the slot element radiate RF signals in their respective native frequencies. Accordingly, such example system may be referred to as a "dual mode" antenna system. The switching can include making and breaking connections to grounds, and/or connecting a signal feed to the first conductive plate or the second conductive plate. In one example dual mode antenna system, a signal feed is in communication with one of the antenna elements (first or second conductive plates), and a switchable ground connection is in communication with one of the first or second conductive plates. When the ground connection is open, the system operates in the first mode, and when the ground connection is closed, the antenna system operates in the second mode.

Other embodiments may provide more than two modes. For example, one embodiment includes a switchable ground connection on both of the conductive plates. Each of the four different ways that ground can be connected (or not connected, as the case may be) represents one mode. Accordingly, such a system may be referred to as a "quad mode" antenna system.

Some embodiments may provide for more than four modes. For instance, one example system includes an active switching network on each of the first and second conductive plates, the active switching networks both switching ground and signal feed. Such a system may provide at least eight modes.

In an example method, an antenna system according to at least one embodiment of the invention radiates in each of at least two modes. In the first mode, a first metal plate radiates at it native frequencies while the first conductive plate also radiates together with a second conductive plate at a second set of resonant frequencies. In a second mode, the first conductive plate and a slot element radiate RF signals, the slot element being defined by the placement of the first and second conductive plates. The switching of modes is accomplished, for example, by switching ground and/or feed connections on one or both of the conductive plates, as described above.

The method may further include radiating signals from the system in more than two modes. In one example method, RF signals are fed to the first conductive plate while ground connections are switched at both of the first and second conductive plates. In another example method, each of the first and second conductive plates includes a switching network that switches both ground and signal feed. The example method includes switching the grounds and feeds to provide at least eight modes.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
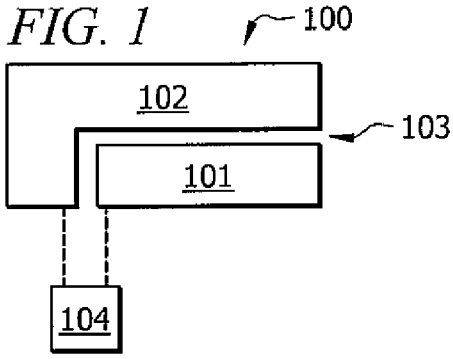
FIG. 1 is an illustration of an exemplary antenna system adapted according to one embodiment of the invention.

FIG. 1 is an illustration of exemplary antenna system 100 adapted according to one embodiment of the invention. Antenna system 100 includes antenna elements 101 and 102 and slot element 103. Slot element 103 is defined by the placement of elements 101 and 102.

Antenna system 100 also includes active switching network 104 that is in electrical communication with one or both of elements 101 and 102. Switching network 104 is operable to switch one or more connections (e.g., signal, ground), thereby causing antenna system 100 to resonate in each of two modes. In the first mode, antenna element 101 resonates at a first set of resonant frequencies while elements 101 and 102 radiate together at a second set of resonant frequencies. In the second mode, antenna element 101 and slot element 103 both resonate. Accordingly, antenna system 100 has at least two different operating modes. The modes themselves and techniques and structures for switching are described in more detail below.

Figure 2:
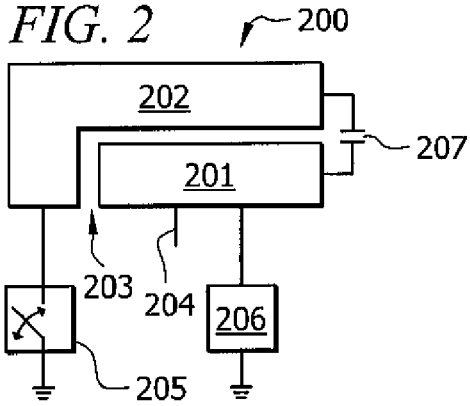
FIG. 2 is an illustration of an exemplary antenna system adapted according to one embodiment of the invention.

FIG. 2 is an illustration of exemplary antenna system 200 adapted according to one embodiment of the invention. System 200 represents one specific, example implementation of a system according to the principles of system 100 (FIG. 1). System 200 includes antenna elements 201 and 202 and slot element 203. Elements 201 and 202 may be disposed, e.g., on a Printed Circuit Board (PCB, not shown). In this example, slot element 203 is a gap between elements 201 and 202, and, therefore, is defined by the placement of elements 202 and 203.

System 200 further includes signal feed 204, which is adapted to receive a signal from a Radio Frequency (RF) module (not shown). Matching network 206 provides impedance matching between elements 201 and 202, and it may include a capacitive, inductive, and/or resistive component, depending on design constraints. Active switching network 205 provides system 200 with a selectable connection to ground from element 202. Switching network 205 selectively makes and breaks a connection to ground, and in some embodiments, may be as simple as a transistor (e.g., a GaAs FET Switch), a Micro Electronic Mechanical System (MEMS) switch, or a pin diode. In this specific example, it is the switching of the ground connection that causes system 200 to operate in one of two modes.

In the first operating mode, switching network 205 breaks the connection to ground. As a result, antenna element 202 is at least partially ungrounded. In this operating mode, element 201 radiates at its set of native frequencies, and both element 201 and 202 radiate in another set of resonant frequencies. The first and second set of resonant frequencies may include one or more possibly overlapping frequency bands. The shape of antenna elements 201 and 202 may be designed to provide performance in one or more established communication bands when in the first operating mode.

In the second operating mode, switching network 205 connects element 202 to ground, thereby at least partially grounding element 202. In this mode, element 201 resonates, as does slot element 203. In this example, in the second mode, element 201 resonates substantially at the same frequencies at which it resonates in the first mode—"substantially" being within 6%. Elements 201 and 203 can resonate in one or more possibly overlapping frequency bands, according to the specific design of system 200. The shape of antenna elements 201 and 202 may be designed to provide performance in one or more established communication bands when in the second operating mode. In one example, antenna system 200 provides performance from 824.2 MHz to 959.8 MHz and 1710.2 MHz to 1989.8 MHz in the first operating mode, thereby a facilitating communication in Global System for Mobile communications (GSM) 850, 900, 1800, and 1900 bands. In the same example, system 200 can provide performance from 1710.2 MHz to 2500 MHz in the second operating mode, thereby facilitating communication in GSM 1800 and 1900, Universal Mobile Telecommunications System (UMTS) 3G, and Wireless Fidelity (WiFi, IEEE 802.11b and g) bands. Accordingly, an example use for system 200 is in handheld devices, such as phones, Personal Digital Assistants (PDAs), email devices, laptop and notebook computers, and the like; however, various embodiments are not limited to any particular application or frequency bands.

System 200 further includes capacitor 207, which affects the tuning of one or more frequency bands in first operating mode without affecting the performance of other frequency bands in the seconding operating mode. Specifically, in this example, capacitor 207 has significant effect on the tuning of the resonant frequencies created by element 201 and element 202 together in first operating mode. The effects of capacitor 207 are determined, at least in part, on its position in system 200 and its size. In addition to, or alternatively to, using a capacitor some designs may employ inductors and/or resistors to achieve desired tuning. Further, some designs may employ a variable capacitor, metal strip, or other element to provide post-manufacturing tuning capabilities, including during operation of the device. In this specific example, capacitor 207 also provides Direct Current (DC) isolation between elements 201 and 202.

Figure 3:
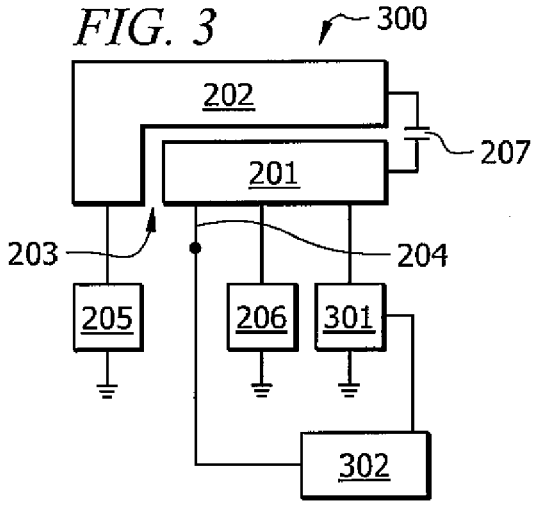
FIG. 3 is an illustration of an exemplary system adapted according to one embodiment of the invention.

FIG. 3 is an illustration of exemplary system 300 adapted according to one embodiment of the invention. System 300 is similar to system 200 (FIG. 2) but includes the addition of active switching network 301 and control system 302. Control system 302 operates switching network 301 and provides RF signals to feed 204. Network 301 may be the same as or similar to network 205, and in this example, performs the same function—making and breaking a connection to ground. Active switching network 301 connects antenna element 201 to ground, thereby at least partially grounding element 201 when it is closed. On the other hand, switching network 301 disconnects element 201 from ground when open, thereby at least partially ungrounding antenna element 201. Accordingly, system 300 offers at least four operating modes:

1. Network 205 open, network 301 open
2. Network 205 open, network 301 closed
3. Network 205 closed, network 301 open
4. Network 205 closed, network 301 closed Modes one and three are the same as described above with regard to FIG. 2. Additionally, system 300 offers modes two and four. In mode two, element 202 and element 201 together contribute a set of resonant frequencies for radiation, while antenna element 201, itself, provides an additional set of resonant frequencies. This is similar to mode one, but with slightly different resonances. In mode four element 201 resonates, as does slot element 203, but with slightly different resonances than in mode three.

Accordingly, system 200 (FIG. 2) may be referred to as a "dual mode" antenna system, and system 300 may be referred to as a "quad mode" antenna system. In some applications, a quad mode system requires little more complexity in design that does a corresponding dual-mode system, such that the gain in performance from using a quad mode antenna may be achieved with little additional cost.

Figure 4:
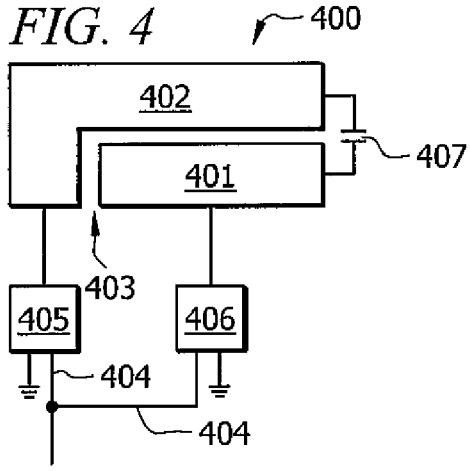
FIG. 4 is an illustration of an exemplary system adapted according to one embodiment of the invention.

While systems 200 and 300 (FIGS. 2 and 3, respectively) employ devices for making and breaking connections to ground, other embodiments further make and break connections to signal feeds. FIG. 4 is an illustration of exemplary system 400 adapted according to one embodiment of the invention. System 400 includes antenna elements 401 and 402 as well as slot element 403. System 400 also includes tuning element 407, which is a capacitor in this example, but can be an inductive and/or capacitive component in other embodiments. Active switching networks 405 and 406 switch feeds 404 and ground and may also, in some embodiments, include impedance matching circuitry. Accordingly, by switching feed 404 either to element 401 or to element 402, system 400 offer two modes, assuming ground connections remain constant. For instance, in one example, feed 404 is at element 401, and element 401 resonates at its native frequencies while elements 401 and 402 resonate together at another set of frequencies. By keeping the same ground configuration when feed 404 is at element 402, element 402 resonates at its native frequencies while elements 401 and 402 resonate together at another set of frequencies.

Figure 5:
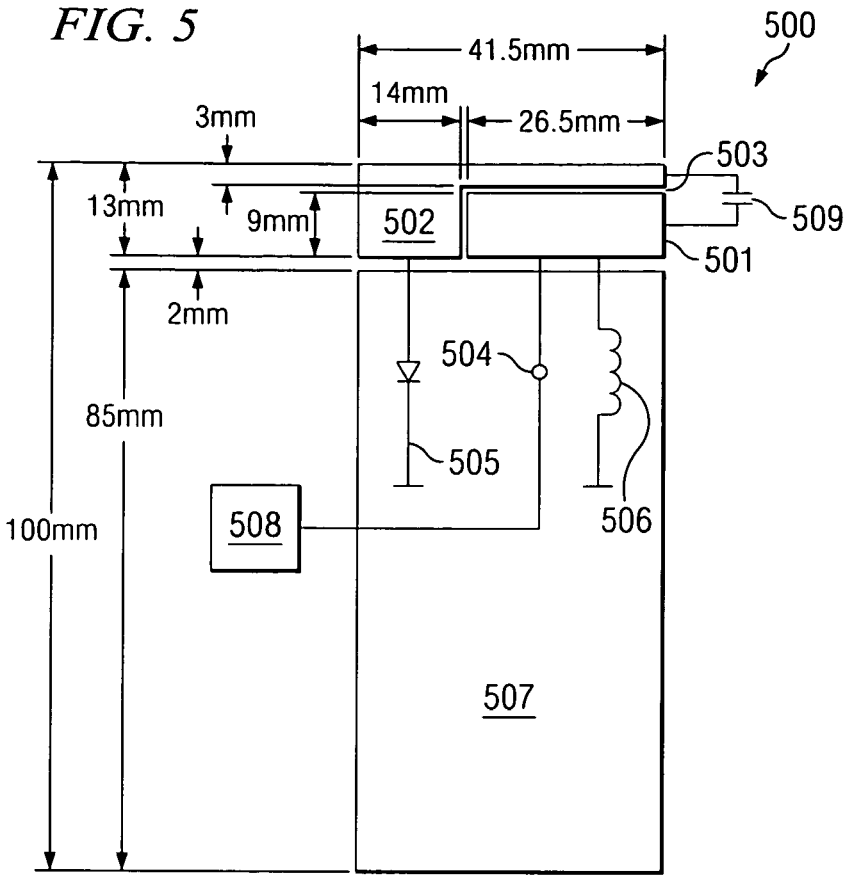
FIG. 5 is an illustration of an exemplary system adapted according to one embodiment of the invention.

In addition to switching feeds, system 400 can also offer four modes (i.e., "quad mode operation") by switching grounds. In this case, either one of switching networks 405 or 406 is used for switching ground. There are two configurations for quad mode operation. The configurations and their modes are:

first configuration (ground stays open at network 406)
i) Feed 404 to element 401, network 405 ground is open
ii) Feed 404 to element 402, network 405 ground is open
iii) Feed 404 to element 401, network 405 ground is closed
iv) Feed 404 to element 402, network 405 ground is closed
or second configuration (ground stays open at network 405)
i) Feed 404 to element 401, network 406 ground is open
ii) Feed 404 to element 402, network 406 ground is open
iii) Feed 404 to element 401, network 406 ground is closed
iv) Feed 404 to element 402, network 405 ground is closed FIG. 5 is an illustration of exemplary system 500 adapted according to one embodiment of the invention. System 500 is an embodiment constructed according to the principles of systems 100 (FIG. 1) and 200 (FIG. 2); however, systems 100 and 200 are not limited to the embodiment shown as system 500.

System 500 includes antenna elements 501 and 502, slot element 503, tuning element 509, and PCB 507. Antenna elements 501 and 502 and slot element 503 are mounted on a part of PCB 507 separate from the portion that includes many of the electronic components of system 500, including active switching network 505 (in this example, a pin diode), feed element 504, and matching network 506. The lower portion of PCB 507 also includes the ground in communication with active switching network 505 and matching network 506. System 500 further includes RF module 508, which sends RF data signals to feed line 504.

Sizes of antenna elements and ground planes affect, at least in part, the frequency response of antenna systems. Various portions of system 500 are given dimensions in FIG. 5, and an antenna system can be constructed according to the dimensions in FIG. 5 to provide communication performance in GSM800/900/1800/1900, UMTS, WLAN, and the 900 MHZ and 2.4 GHz bands of Industrial, Scientific, and Medical Band (ISM).

Figure 6:
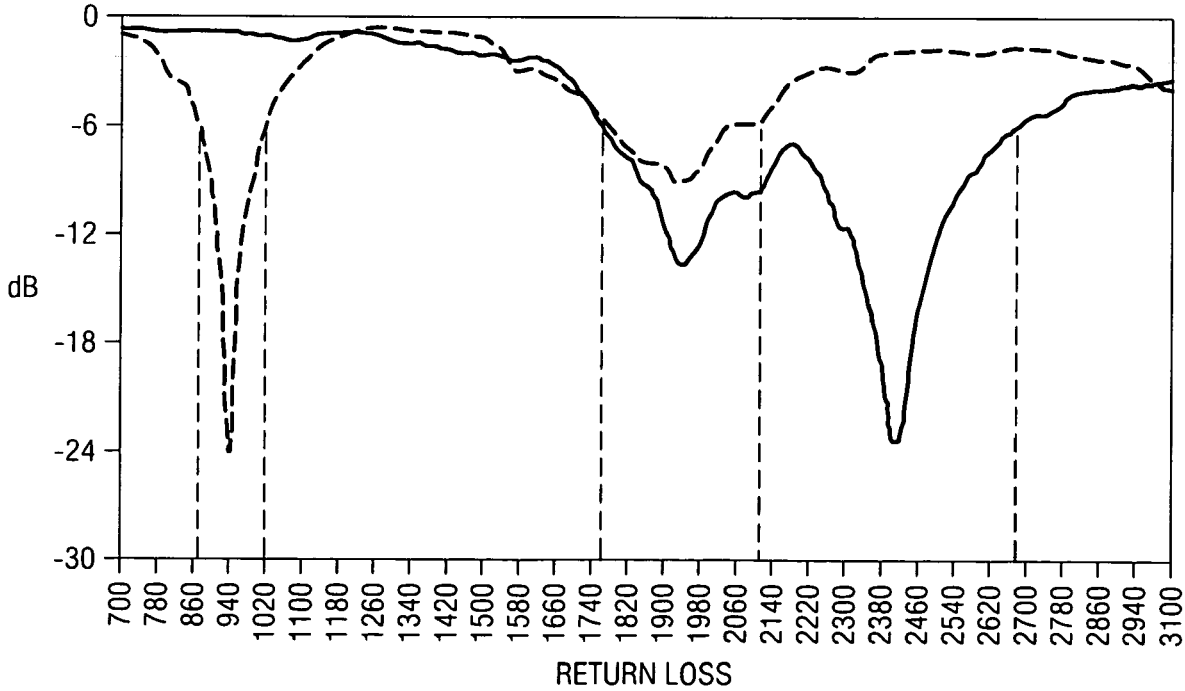
FIG. 6 is a graph of the frequency response of an example prototype antenna system built according to one embodiment of the invention.

FIG. 6 is a graph of the frequency response of an example prototype antenna system built according to the dimensions of system 500. In a first mode (mode 0), active switching network 505 (FIG. 5) is opened, thereby causing element 502 to be ungrounded. Element 501 resonates at its native frequencies, and elements 501 and 502 resonate together at another set of frequencies. The frequency response of system 500 in mode 0 is shown in dashed lines in FIG. 6.

In a second mode (mode 1), active switching network 505 is closed, thereby grounding element 502. Element 501 and slot element 503 resonate. The frequency response is shown in a solid line in FIG. 6. In this example, the frequency responses of both modes overlap. In fact, both responses show a resonance centered approximately in the 1950 MHz range, and such resonance is a result of element 501, which radiates in both modes. The left-most resonance of mode 0 is produced by element 501 and element 502 resonating together. The right-most resonance of mode 1 is produced by slot element 503.

Various embodiments are not limited to the shapes and sizes of the example implementations of FIGS. 1-5, nor do they have to be mounted on PCBs Further, various components of any embodiment may be shaped and/or scaled for different performance characteristics. For instance, geometries and placements of antenna elements affect the frequency response of any given system. Further, component types and values of a tuning component and a matching component may also affect the performance of a given antenna system.

Figure 7:
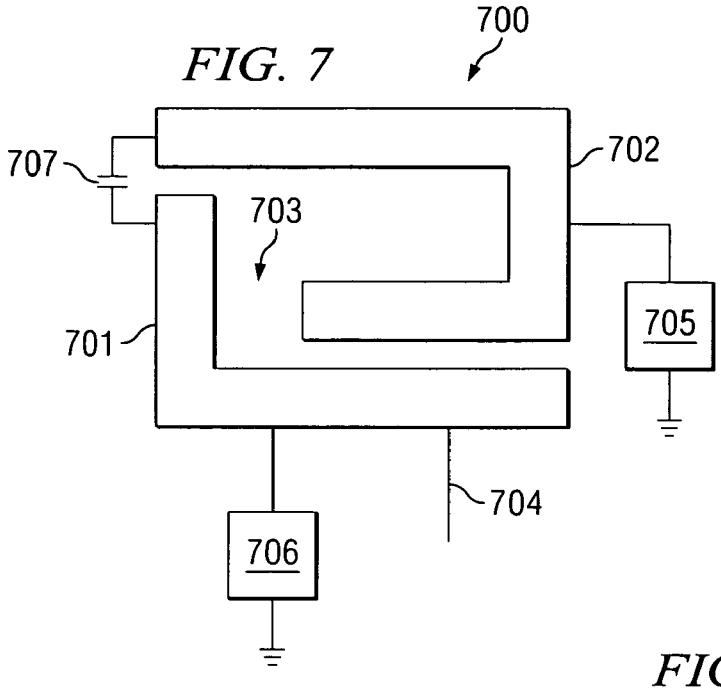
FIG. 7 is an illustration of an exemplary system adapted according to one embodiment of the invention.

FIG. 7 is an illustration of exemplary system 700 adapted according to one embodiment of the invention. System 700 has a different shape than that of the systems of the previous examples, but its principles of operation are the same. System 700 includes antenna elements 701, 702, slot element 703, feed 704, and matching network 706, tuning element 707. Similar to system 200 (FIG. 2), system 700 also includes active switching network 705 that makes and breaks a connection to ground from element 702.

System 700 includes two modes. In the first mode, active switching network 705 is open while RF signals are received from feed 704, and element 701 resonates at its native frequencies. The first mode employs element 702 to resonate together with element 701 at another set of frequencies. In the second mode, active switching network 705 is closed while RF signals are received from feed 704. In this mode, both element 701 and slot element 703 resonate.

Embodiments according to the design of FIG. 7, as well as other embodiments, may be adapted to include another active switching network (not shown) connecting element 701 to ground, thereby providing at least four modes of operation, similar to the performance described above with regard to FIG. 3. Additionally or alternatively, system 700 may include switched feed networks (not shown) to provide two modes, four modes and eight modes of operation, as explained above with regard to FIG. 4. Modifications of various systems are possible to adapt those systems to provide two, four, or eight modes.

Figure 8:
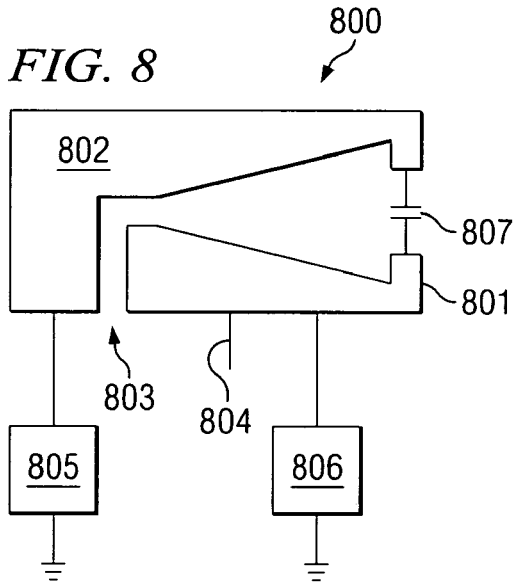
FIG. 8 is an illustration of an exemplary system adapted according to one embodiment of the invention.

FIG. 8 is an illustration of exemplary system 800 adapted according to one embodiment of the invention. Like system 700, system 800 has a different shape than that of the systems of the previous examples, but its principles of operation are the same. System 800 includes antenna elements 801, 802, slot element 803, feed 804, and matching network 806, tuning element 807. System 800 also includes active switching network 805 that makes and breaks a connection to ground from element 802. System 800 can be operated in modes, as described above with regard to systems 200 (FIG. 2) and 700.

FIGS. 9A-9E are illustrations of exemplary configurations 901-905 of antenna systems according to several embodiments. Configurations 901-905 show positional relationships between ground plane 920 and component 910 that may be employed in various embodiments. Component 910 includes at least a first, second, and slot element for an antenna system. Configuration 901 shows component 910 completely overlapping with ground plane 920. By contrast, configuration 902 shows component 910 co-planar with ground plane 920, and there is no overlap. Configuration 903 is similar to configuration 902, except that configuration 903 includes some amount of z-axis offset by component 910, such that component 910 and ground plane 920 are not co-planar, but rather, are in parallel planes. Configuration 904 shows component 910 placed in a plane that is not parallel with ground plane 920. Configuration 905 shows partial overlap between component 910 and ground plane 920. There is also some amount of z-axis offset in configuration 905. Configurations 901-905 are exemplary, and FIG. 9 is not exhaustive of the configurations that may be used with one or more embodiments.

Figure 10:
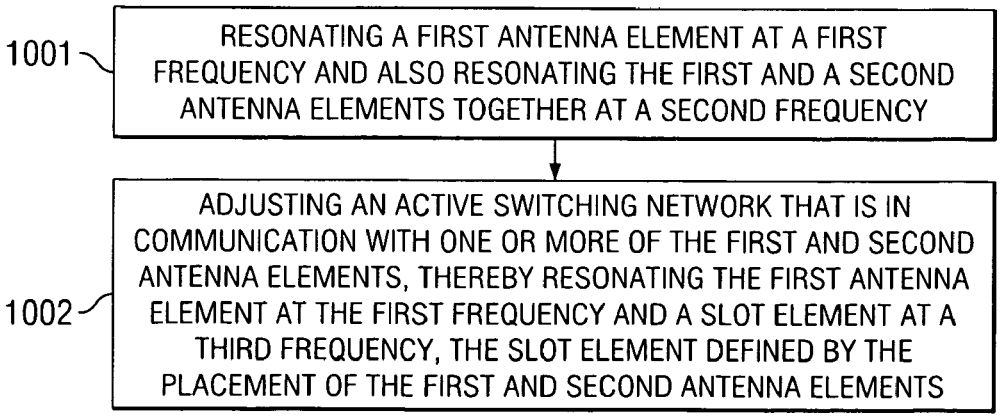
FIG. 10 is an illustration of an exemplary method adapted according to one embodiment of the invention.
Figure 9A:
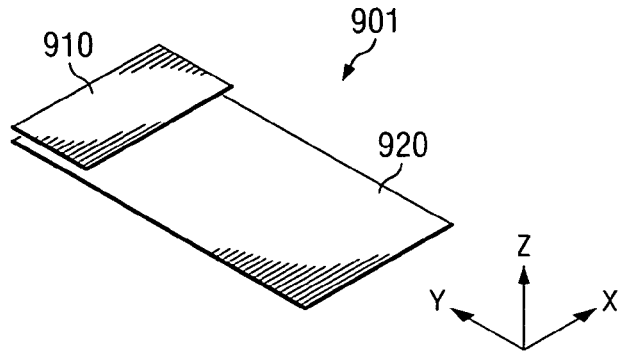
FIGS. 9A-9E are illustrations of exemplary arrangements adapted according to several embodiments.
Figure 9B:
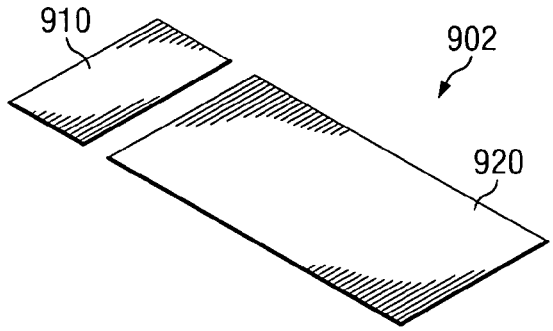
Figure 9C:
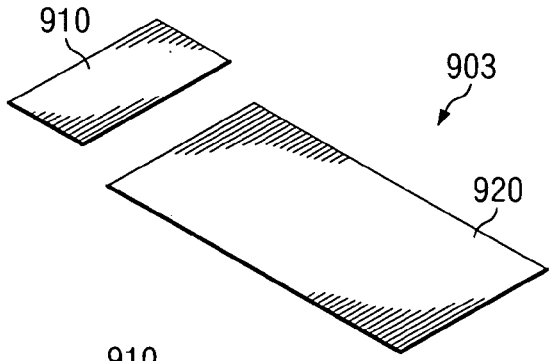
Figure 9D:
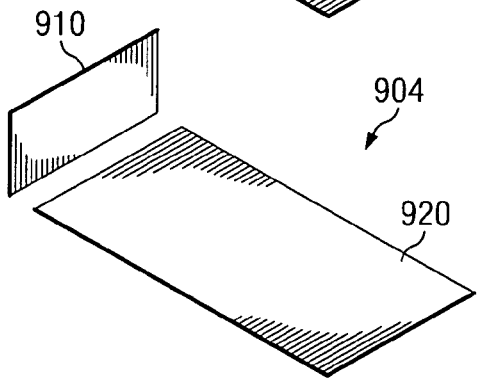
Figure 9E:
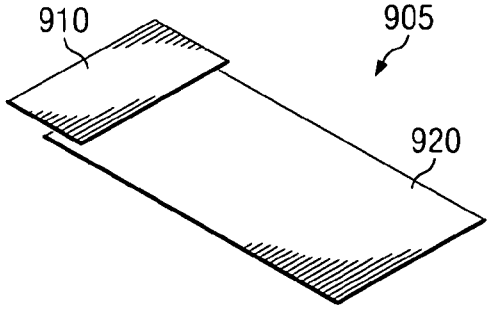

FIG. 10 is an illustration of exemplary method 1000 adapted according to one embodiment of the invention. Method 1000 may be performed, for example, by an antenna control system (e.g., control system 302 of FIG. 3) that operates switching networks and provides RF signals to an antenna system, such as those described in the above examples. In step 1001, a first antenna element is resonated a first set of frequencies, and the first and a second antenna element in the antenna system are resonated at a second set of frequencies. Step 1001 may be performed, for example, by providing RF signals to the first antenna element and at least partially disconnecting the second antenna element from a ground. Various techniques may be used to provide RF signals to the first antenna element while at least partially disconnecting the second element from ground. In one embodiment, a fixed signal feed is connected to the first antenna element, and an active switching network provides a connection from the second antenna element to ground. Additionally or alternatively, active feeding networks may be used, which switch both ground and feed and are connected to each of the first and second antenna elements.

In step 1002, an active switching network that is in communication with one or more of the first and second antenna elements is adjusted, thereby resonating the first antenna element at the first set of frequencies and a slot element at a third set of frequencies. Further, the slot element is defined by the placement of the first and second antenna elements. Step 1002 may be performed, for example, by providing RF signals to the first antenna element while at least partially grounding the second antenna element, and such operation may be facilitated by the use of fixed feed/active ground switching and/or active feeding networks, as explained above.

Although method 1000 is described in terms of "steps," it should be noted that various embodiments are not limited to any particular order of performing those steps. For instance, it is within the scope of the invention for an antenna system to operate in a mode wherein a first antenna element and a slot element resonate and then to switch to a mode wherein the first antenna element resonates and the first and second antenna elements resonate together. Further, various embodiments are not limited to two modes, but may be adapted to perform at least four or eight modes in any given order.

Various embodiments of the present invention provide one or more advantages over the prior art. For instance, switching between the use of a slot element and a second antenna element may provide larger frequency band jumps than systems that merely switch parasitic elements. Accordingly, various embodiments of the invention may provide modes that span a larger spectrum, in contrast to systems that merely switch parasites on or off to modify the operation of parasites.

Another advantage of some embodiments is efficiency of volume. For instance, various embodiments use two antenna elements to define a third element—a slot element—thereby using space between the elements as a resonating element. Efficiency of volume may allow various embodiments to be used in applications that are especially space-sensitive and demanding of bandwidth.

Yet another advantage is that a tuning element, such as element 207 (FIG. 2), can be used in various embodiments to independently tune the set of resonances caused by the first and second antenna elements resonating together. Accordingly, such frequency bands can be tuned while requiring little, if any, accounting for the effects thereof on the other resonances provided by the antenna system.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna system comprising:

a first antenna element;

a second antenna element, said first and second elements defining a slot antenna element;

an active switching network in communication with one or both of said first and second antenna elements, said switching network operable to cause said antenna system to resonate in each of two modes:

a first mode of said modes wherein said first element resonates at a first set of frequencies, and said first element and said second element resonate together at a second set of frequencies; and a second mode of said modes wherein said first element resonates substantially at said first set of frequencies, and said slot antenna element resonates at a third set of frequencies.

2. The system of claim 1 wherein said active switching network is adapted to switch one or more connections to ground.

3. The system of claim 2 wherein said active switching network comprises a switchable ground connection in communication with said second antenna element, and a signal feed is in communication with said first antenna element.

4. The system of claim 3 wherein said system is adapted to operate in said first mode when said switchable ground connection is open and to operate in said second mode when said switchable ground connection is closed.

5. The system of claim 1 wherein said active switching network includes a first switchable ground connection in communication with said first antenna element and a second switchable ground connection in communication with said second antenna element, said active switching network operable to cause said antenna system to resonate in two additional modes:

a third mode of said modes wherein said first switchable ground connection is closed and said second switchable ground connection is open; and a fourth mode of said modes wherein said first and second switchable ground connections are closed.

6. The system of claim 5 wherein said active switching network includes a first switchable signal feed connection in communication with said first antenna element and a second switchable signal feed connection in communication with said second antenna element, and said system is adapted to operate in four additional modes:

a fifth mode wherein said second feed connection is closed, said first feed connection is open, said first ground connection is open, and said second ground connection is open;

a sixth mode wherein said second feed connection is closed, said first feed connection is open, said first ground connection is open, and said second ground connection is closed;

a seventh mode wherein said second feed connection is closed, said first feed connection is open, said first ground connection is closed, and said second ground connection is open;

a eighth mode wherein said second feed connection is closed, said first feed connection is open, said first ground connection is closed, and said second ground connection is closed.

7. The system of claim 1 wherein said first and second antenna elements are disposed on a Printed Circuit Board (PCB).

8. The system of claim 1 further including a connecting element between said first and second antenna elements, said connecting element including one or more of:

a capacitor;

an inductor;

a metal strip; and a resistor.

9. The system of claim 1 wherein said first and second modes have overlapping resonances.

10. The system of claim 1 further including a matching network to match impedances of said first and second elements.

11. A method for operating an antenna system, said method comprising:

resonating a first antenna element at a first set of frequencies while resonating said first antenna element and a second antenna element in said antenna system at a second set of frequencies;

adjusting an active switching network that is in communication with one or more of said first and second antenna elements, thereby resonating said first antenna element substantially at said first set of frequencies and a slot antenna element at a third set of frequencies, said slot antenna element defined by the placement of said first and second antenna elements.

12. The method of claim 11 wherein said active switching network comprises a first switchable ground connection in communication with said second antenna element, and wherein said adjusting said active switching network comprises closing said first switchable ground connection.

13. The method of claim 12 wherein said active switching network further comprises a second switchable ground connection in communication with said first antenna element, said method further comprising:

closing said second switchable ground connection and opening said first switchable ground connection, thereby causing at least said first and second elements to resonate at a fourth set of frequencies; and closing said second switchable ground connection and closing said first switchable ground connection, thereby causing at least said slot element to resonate at a fifth set of frequencies.

14. The method of claim 11 wherein said active switching network includes a first switchable feed connection in communication with said first antenna element and a second switchable feed connection in communication with said second antenna element, the method further comprising:

opening said first switchable feed connection;

closing said second switchable feed connection, thereby causing at least said second antenna element to resonate.

15. The method of claim 11 wherein said antenna system includes a connection element connecting said first and second antenna elements, said method further comprising adjusting said connection element to tune a resonance of said second frequency.

16. The method of claim 11 wherein said resonating said first antenna element and said second antenna element comprises providing performance in a first frequency band, said resonating said first antenna element and said slot antenna element comprises providing performance in a second frequency band, said first and second frequency bands overlapping each other.

17. An antenna system comprising:

a first antenna element;

a second antenna element;

a slot antenna element defined by said first and second antenna elements; and means in communication with one or both of said first and second antenna elements for causing said antenna system to operate in each of two modes:

a first mode of said modes wherein said first element resonates at a first set of frequencies, and said first element and a second element resonate together at a second set of frequencies; and a second mode of said modes wherein said first element resonates substantially at said first set of frequencies, and said slot antenna element resonates at a third set of frequencies.

18. The system of claim 17 wherein said means for causing comprise a control system adapted to switch between said first mode and said second mode during operation of the antenna system.

19. The system of claim 17 wherein said means for causing comprise a switchable ground connection in communication with said second antenna element.

20. The system of claim 17 wherein said means for causing comprise a switchable feed connection in communication with said first antenna element and a switchable feed connection in communication with said second antenna element.

21. The system of claim 17 further comprising means for tuning said second set of frequencies, said means for tuning in communication with said first and second antenna elements.

22. The system of claim 17 wherein portions of said system are mounted on a Printed Circuit Board (PCB).

23. An antenna system comprising:

a first antenna element connected to a signal feed providing radio frequency signals;

a second antenna element, said first and second antenna elements defining a slot antenna element;

an active switching network connected to said second antenna element, said switching network connected to a ground and providing a switchable connection to said ground from said second antenna element; said switching network operable to cause said antenna system to resonate in each of two modes:

a first mode of said modes wherein said first element resonates at a first set of frequencies, and said first element and said second element resonate together at a second set of frequencies, said first mode achieved when said switching network disconnects said ground; and a second mode of said modes wherein said first element resonates substantially at said first set of frequencies, and said slot antenna element resonates at a third set of frequencies, said second mode achieved when said switching network completes a connection to said ground.

24. The system of claim 23 wherein said first and second antenna elements are disposed on a Printed Circuit Board (PCB).

25. The system of claim 23 further including a connecting element between said first and second antenna elements, said connecting element including one or more of:

a capacitor;

an inductor;

a metal strip; and a resistor.

26. The system of claim 23 wherein said first and second modes have overlapping resonances.

27. The system of claim 23 further including a matching network to match impedances of said first and second elements.

* * * * *

UNITED STATES PATENT AND TRADEMARK OFFICE

CERTIFICATE OF CORRECTION

PATENT NO. : 7,616,158 B2
APPLICATION NO. : 11/441823
DATED : November 10, 2009
INVENTOR(S) : Mak et al.

It is certified that error appears in the above-identified patent and that said Letters Patent is hereby corrected as shown below:

In the specification:

Column 6, Line 30, delete the portion of text reading "network 405" and replace with --network 406--.

Signed and Sealed this

Nineteenth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,616,158 B2
APPLICATION NO. : 11/441823
DATED : November 10, 2009
INVENTOR(S) : Mak et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 167 days.

Signed and Sealed this

Nineteenth Day of October, 2010

David J. Kappos

David J. Kappos
*Director of the United States Patent and Trademark Office*